US010293245B2

(12) United States Patent
Murase et al.

(10) Patent No.: US 10,293,245 B2
(45) Date of Patent: May 21, 2019

(54) PROTECTIVE BAG FOR CARDS AND THE LIKE

(71) Applicants: Premium Inc., Ehime (JP); GC Tokyo Co., Ltd., Tokyo (JP)

(72) Inventors: Ryoji Murase, Tokyo (JP); Shunji Miyauchi, Ehime (JP)

(73) Assignees: PREMIUM INC., Ehime (JP); GC TOKYO CO., LTD., Tokyo (JP)

( * ) Notice: Subject to any disclaimer, the term of this patent is extended or adjusted under 35 U.S.C. 154(b) by 0 days.

(21) Appl. No.: 15/503,775

(22) PCT Filed: Nov. 10, 2014

(86) PCT No.: PCT/JP2014/005619
§ 371 (c)(1),
(2) Date: Feb. 14, 2017

(87) PCT Pub. No.: WO2016/075719
PCT Pub. Date: May 19, 2016

(65) Prior Publication Data

US 2017/0274273 A1 Sep. 28, 2017

(51) Int. Cl.
*B65D 75/30* (2006.01)
*A63F 1/06* (2006.01)
(Continued)

(52) U.S. Cl.
CPC ..... *A63F 1/062* (2013.01); *A45C 11/182* (2013.01); *A63F 1/10* (2013.01); *B65D 65/10* (2013.01); *B65D 75/30* (2013.01)

(58) Field of Classification Search
CPC ..... A45C 11/18; A45C 11/182; A63F 1/10; A63F 1/062; B65D 65/10; B65D 75/30;
(Continued)

(56) References Cited

U.S. PATENT DOCUMENTS 867,789 A * 1/1906 Bushnell ..... B42F 7/06 229/67.1
5,700,036 A 12/1997 Smith, III

FOREIGN PATENT DOCUMENTS

JP 2007-283686 A 11/2007
JP 2009-95984 A 5/2009
(Continued)

OTHER PUBLICATIONS

International Search Report for PCT/JP2014/005619 dated Feb. 10, 2015.

*Primary Examiner* — Mollie Impink
(74) *Attorney, Agent, or Firm* — Pearne & Gordon LLP

(57) ABSTRACT

Provided is a protective bag for cards and the like in which four-corner outer edges of the protective bag run along circular arc-shaped four-corner outer edges of cards or the like and in which four-corner inner edges within the protective bag and circular arc-shaped four-corner outer edges of the cards or the like fit each other. The protective bag is a protective bag for cards and the like, the protective bag includes two rectangular-shaped films of equal shape and size which are superposed on each other without any positional shift, three sides of the rectangular shape are sealed so that an opening part is formed at one remaining side thereof. Each corner of the protective bag is formed into a circular-arc shape, and two base corner portions opposed to the opening part are opened without being sealed.

8 Claims, 7 Drawing Sheets

(51) Int. Cl.
*A63F 1/10* (2006.01)
*B65D 65/10* (2006.01)
*A45C 11/18* (2006.01)

(58) Field of Classification Search
CPC . B42F 21/12; B26D 2007/0068; B31B 70/14; B31B 70/16; B31B 70/18; B31B 70/64–70/68; B31B 70/642; B31B 2241/00; B31B 2241/007; B31B 2160/10; B65B 43/06
USPC ..... 383/67, 907, 103, 116, 94; 229/67.1; 206/484.2; D3/247, 227; 493/199, 287; 40/654.01, 776
See application file for complete search history.

(56) References Cited

FOREIGN PATENT DOCUMENTS

| | | | |
|---|---|---|---|
| JP | 2011-56837 | A | 3/2011 |
| JP | 2014-983 | A | 1/2014 |
| JP | 3193045 | U | 8/2014 |

* cited by examiner

PROTECTIVE BAG FOR CARDS AND THE LIKE

TECHNICAL FIELD

The present invention relates to a protective bag for cards and the like such as character cards, playing cards, name tags, payment or other slips, vouchers, and various leaflets. More specifically, the invention relates to a protective bag for cards and the like in which four-corner outer edges of the protective bag run along circular arc-shaped four-corner outer edges of cards or the like and moreover in which four-corner inner edges within the protective bag and the circular arc-shaped four-corner outer edges of the cards or the like fit each other.

BACKGROUND ART

This type of protective bag for cards and the like is, in general, formed into a rectangular shape from transparent synthetic resin film such as polyvinyl chloride film and used as protective bags through which character designs or letters printed on cards or the like such as character cards, playing cards, name tags, payment or other slips, vouchers, and various leaflets can be seen. Those protective bags for cards and the like are used, with an adhesive applied to its outer surface, also as a head part of a file or the like or as a card-holding pocket on the back cover of a product catalog or the like, and others.

Recently, there have been being enthusiastically played competition-type trading card games in which, with a collection of character cards having Pokémon (registered trademark) or other popular characters printed thereon and further having circular arc-shaped four corners, one card in the highest position is extracted and presented out of the player's own stacked cards one by one for use in play.

Under such circumstances, conventional protective bags, having right-angled edges at the four corners, have suffered a difficulty that when in use, particularly in an operation of cutting cards, which is so called shuffle, the player feels a pain at the hands due to those sharp edges. Moreover, those protective bags do not fit the cards in terms of shape, causing misalignment of the cards within the protective bag or other results. Thus, the player cannot get a feeling of using the cards themselves, leading to a problem of poor handleability.

This being the case, some players privately cut and remove corner portions of the protective bag in conformity to the shape of the cards or the like by a corner cutter or the like so that right-angled edges of the protective bag are formed into circular arc-shaped ones. Unfortunately when the cards or the like within the protective bag are exposed outside due to the removal of the corner portions, it follows not only that the corner portions of the cards or the like become more easily breakable but also that oils and sweats of the hand adhere to the cards or the like and moreover, for example, refuse, dust and the like enter the protective bag, causing the cards or the like to be contaminated as further problems. Improvements in these aspects have been desired heretofore.

A related art of PTL 1 is known as a conventional protective bag for cards and the like. This protective bag H, as shown in FIG. 7, indeed has outer edges 101 of its base corner portions cut each into a circular-arc shape with the result that no sharp edges are included in the bag. However, because inner edges 102 of the base corner portions are angled, it would be the case that the inner edges 102 of the base corner portions in the protective bag H and circular arc-shaped outer edges of the cards or the like do not fit each other in the protective bag H.

Also in the protective bag H, a base-part sealed portion 103 and side-part sealed portions 104 are provided with a large width, giving rise to a large difference in size between the protective bag H and the cards or the like to be contained therein. Thus, the protective bag H has been unfit for playing of games as it remains in use with the cards or the like therein.

CITATION LIST

Patent Literature

PTL 1: JP 2011-56837 A

SUMMARY OF INVENTION

Technical Problem

The present invention having been accomplished in view of the above-described circumstances, an object of the invention is to provide a protective bag for cards and the like in which four-corner outer edges of the protective bag run along circular arc-shaped four-corner outer edges of cards or the like and moreover in which four-corner inner edges within the protective bag and circular arc-shaped four-corner outer edges of the cards or the like fit each other, thus the protective bag being capable of preventing the player from feeling a pain at the hands as well as of preventing breaks at the corners of the protective bag so that the cards or the like can be protected while being kept from contamination.

Solution to Problem

In a first aspect of the invention, there is provided a protective bag for cards and the like, the protective bag comprising rectangular-shaped two films of equal shape and size which are superposed on each other without any positional shift, three sides of the rectangular shape being sealed so that an opening part is formed at one remaining side thereof, wherein four corners of the protective bag are formed each into a circular-arc shape, and the three sides are sealed except the opening part and base-side two base corner portions.

In a second aspect of the invention, in the protective bag for cards and the like as defined in the first aspect, the base corner portions are cut each into a circular-arc shape without being welded.

In a third aspect of the invention, in the protective bag for cards and the like as defined in the second aspect, a pair of lateral sides are formed by fusion cutting, and the base is formed by ultrasonic welding and subsequent cutting.

Advantageous Effects of Invention

According to the first aspect of the invention, the following advantageous effects are produced:

a) By virtue of the arrangement that the four corners of the protective bag for cards and the like are rounded and the base corner portions are sealed along their shape, when cards or the like generally equal in shape and size to the protective bag for cards and the like are contained therein, rounded four corners of the cards fit the rounded four corners of the protective bag for cards and the like, so that no excess sealing margin is formed. As a result, in playing card games or the like, the player is enabled to enjoy the game or the like with a feeling of touching the cards themselves; and b) Since the four corners are circular arc-shaped and yet base-part corners are not welded and opened so as to be soft, the player is never injured at the hands and fingers or the like by sharp-angled four corners.

According to the second aspect of the invention, not the base corner portions of the protective bag for cards and the like are fusion cut, but the base corner portions are formed by being cut each into a circular-arc shape. Therefore, it is made possible to manufacture the protective bag for cards and the like as described above.

According to the third aspect of the invention, the protective bag for cards and the like is so made up that a pair of lateral sides are formed by fusion cutting, and the base is formed by ultrasonic welding and subsequent cutting. Therefore, it is made practicable to subject a continuation of two-ply sheet-like films to continuous processing including the process of sealing the base corner portions each into a circular-arc shape and moreover cutting the base corner portions together with the opening corner portions each into a circular-arc shape before the protective bags for cards and the like are finally fusion cut individually so as to be manufactured on a one-unit basis. By virtue of this, the protective bags for cards and the like can be mass produced.

BRIEF DESCRIPTION OF DRAWINGS

FIG. 1 is a perspective view showing a makeup of a protective bag A for cards and the like;

FIG. 2A shows a state before insertion of cards and FIG. 2B shows a state after the insertion of the cards;

FIG. 3 is a flowchart showing the flow of a manufacturing method for the protective bag A for cards and the like;

DESCRIPTION OF EMBODIMENTS

Hereinbelow, a protective bag for cards and the like according to an embodiment of the invention will be described in terms of its makeup with reference to the accompanying drawings.

Figure 1:
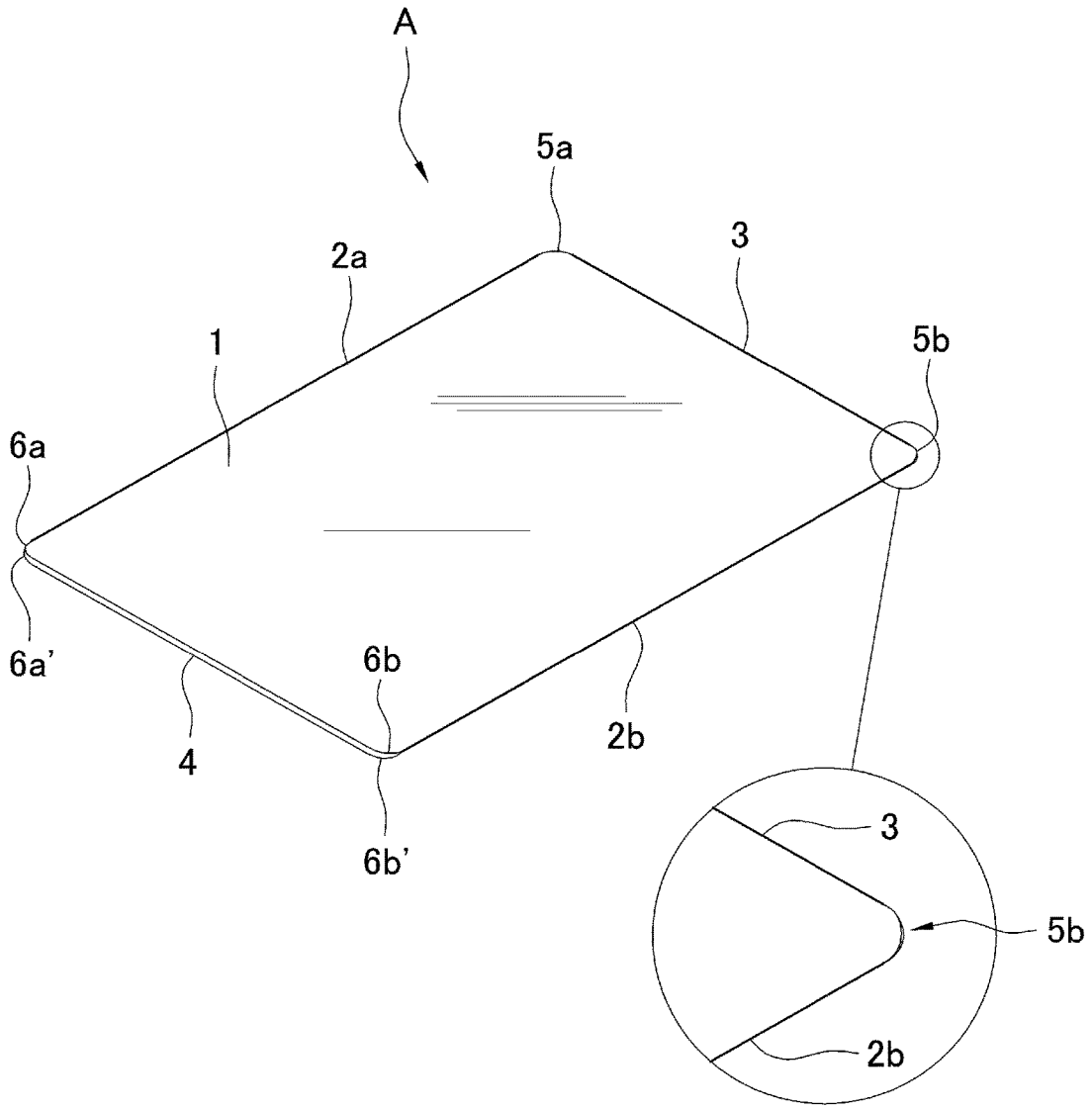

The protective bag A for cards and the like according to the invention, as shown in FIG. 1, is basically formed into a bag shape from superposed two quadrangular films 1, 1. More details thereof are as follows.

Figure 2A:
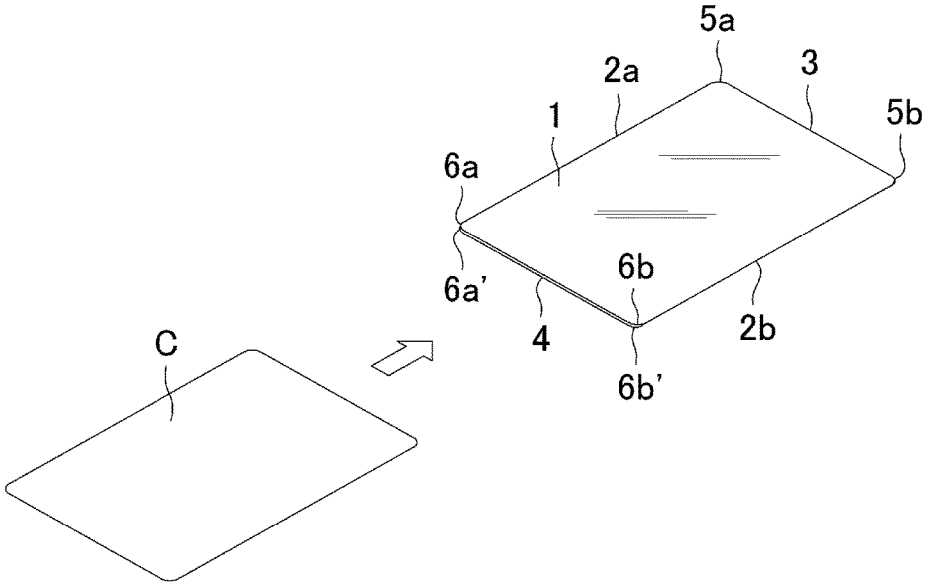
FIGS. 2A and 2B are explanatory views of a way how the protective bag A for cards and the like is used, where
Figure 2B:
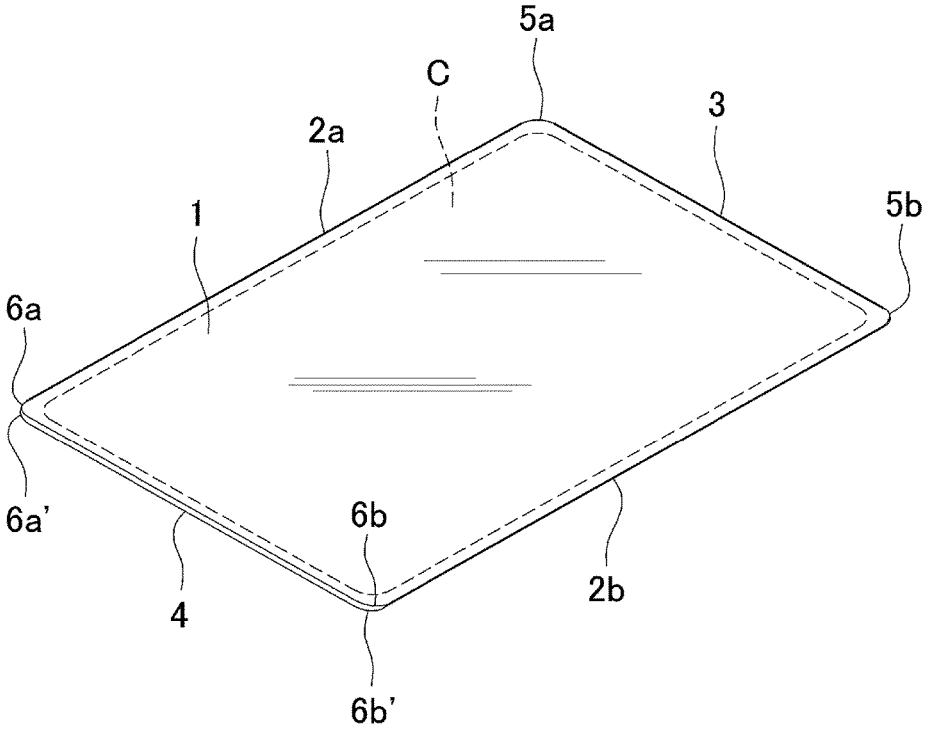

The films 1, 1 have a rectangular shape having four corners each rounded into a circular-arc shape. The films 1, 1 include: lateral sides 2*a*, 2*b* formed of a pair of sealed longitudinal sides of the films 1; a base 3 formed of one sealed widthwise side of the films 1; an opening part 4 provided at one end side opposed to the base 3 and serving for letting cards or the like in and out; base 3-side two base corner portions 5*a*, 5*b* each formed into a circular-arc shape and sealed along the shape; and opening part 4-side opening corner portions 6*a*, 6*b* each formed into a circular-arc shape and not sealed. As shown in FIGS. 2A and 2B, the protective bag is to be used with cards or the like contained inside.

Each film 1 is formed of, for example, a polypropylene or other synthetic resin film having transparency. Instead, the film 1 may be a polyethylene or other synthetic resin film without limitation to polypropylene.

The lateral sides 2*a*, 2*b* are formed by fusion cutting. A sealing width of the lateral sides 2*a*, 2*b* is set to such a narrow one that no excess sealing margin is formed at the lateral sides. As shown in FIGS. 2A and 2B, when cards or the like generally equal in shape and size to the protective bag A for cards and the like are contained therein, a widthwise inner length of the protective bag A for cards and the like becomes generally equal to a lateral width of the cards or the like to be contained therein, so that the cards or the like fit the protective bag A for cards and the like in its widthwise direction.

The base 3 is formed by ultrasonic welding and subsequent cutting. The sealing width of the base 3 is set to such a narrow one that no excess sealing margin is formed, as in the lateral sides 2*a*, 2*b*. On the other hand, the opening part 4 is not sealed. Therefore, when cards or the like generally equal in shape and size to the protective bag A for cards and the like are contained therein, a longitudinal inner length of the protective bag A for cards and the like becomes generally equal to a longitudinal width of the cards or the like to be contained therein. Thus, the cards or the like fit the protective bag A for cards and the like in its longitudinal direction.

Because one lateral side of the two films 1 is not sealed, the opening part 4 is formed so as to let cards or the like in and out therethrough.

The base corner portions 5*a*, 5*b* are cut each into a circular-arc shape without being welded at all. For example, the base corner portions 5*a*, 5*b* are formed by being cut each into a circular-arc shape having a diameter of 1 to 4 mm φ, preferably 3 mm φ. In addition, the diameter of the base corner portions 5*a*, 5*b* may be changed, as required, depending on the size of the cards or the like to be contained, without limitation to the above-described sizes.

The opening corner portions 6*a*, 6*b* are formed by being cut each into a circular-arc shape having a diameter of 1 to 4 mm φ, preferably 3 mm φ, as an example. The opening corner portions 6*a*, 6*b* are not sealed so that the opening part 4 is easily openable and easily lets cards or the like in and out therethrough. In addition, the diameter of the opening corner portions 6*a*, 6*b* may be changed, as required, depending on the size of the cards or the like to be contained, without limitation to the above-described sizes.

The base corner portions 5*a*, 5*b* and the opening corner portions 6*a*, 6*b* are cut each into a circular-arc shape and moreover the sealing width of the lateral sides 2*a*, 2*b* and the base 3 is set to such a narrow one that no excess sealing margin is formed. As a result of this arrangement, when cards generally equal in shape and size to the protective bag A for cards and the like are contained therein, the cards or the like fit the protective bag A for cards and the like in its inside. Moreover, when playing a card game or the like, the player can enjoy the game or the like with a feeling of touching the cards themselves.

With the protective bag according to this embodiment, since the base corner portions 5*a*, 5*b* are formed by cutting as described above, small openings are generated at the base corner portions 5*a*, 5*b*. However, with those openings generated, the base corner portions 5*a*, 5*b* do not become excessively hard and can retain softness, so that the player no longer suffers a pain at the hands during the use of cards.

Next, a manufacturing method of the protective bag A for cards and the like according to the invention will be described with reference to FIGS. 3 to 6.

Figure 3:
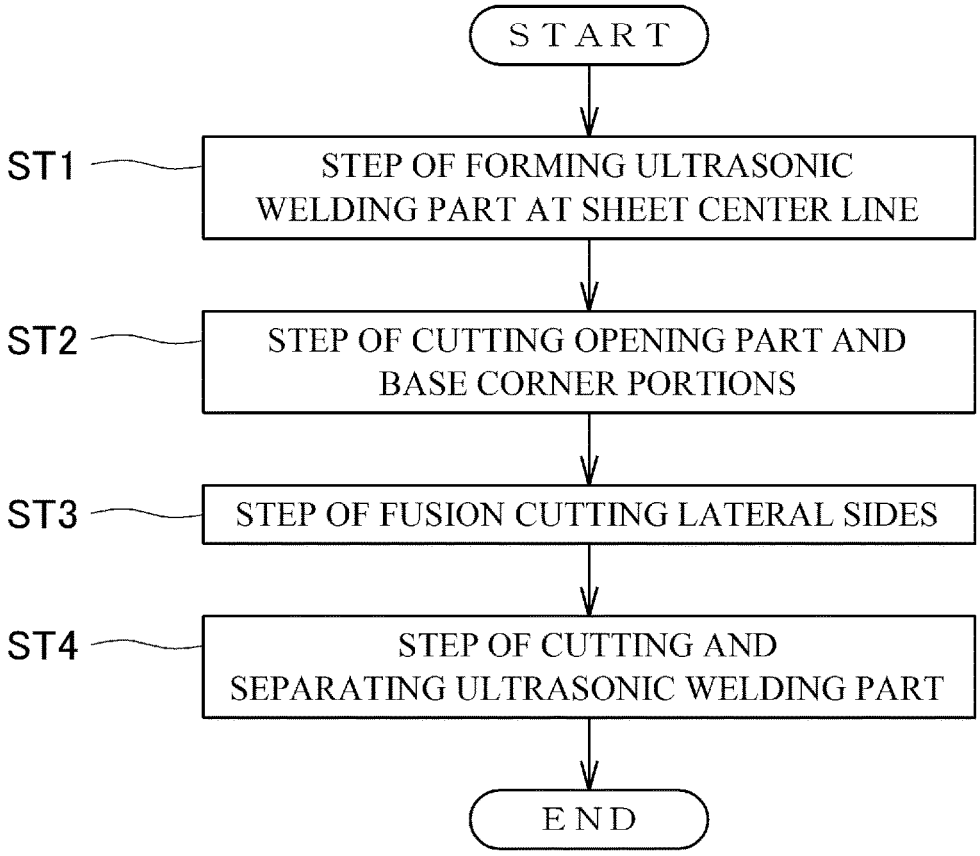
Figure 4:
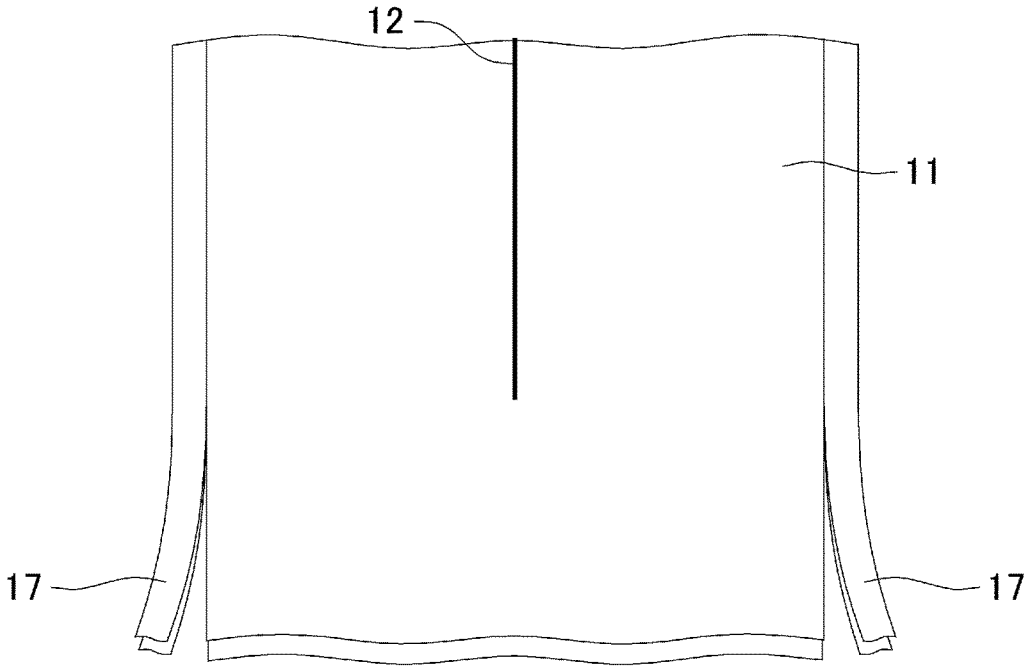
FIG. 4 is an explanatory view of a formation method for an ultrasonic welded part.
Figure 5:
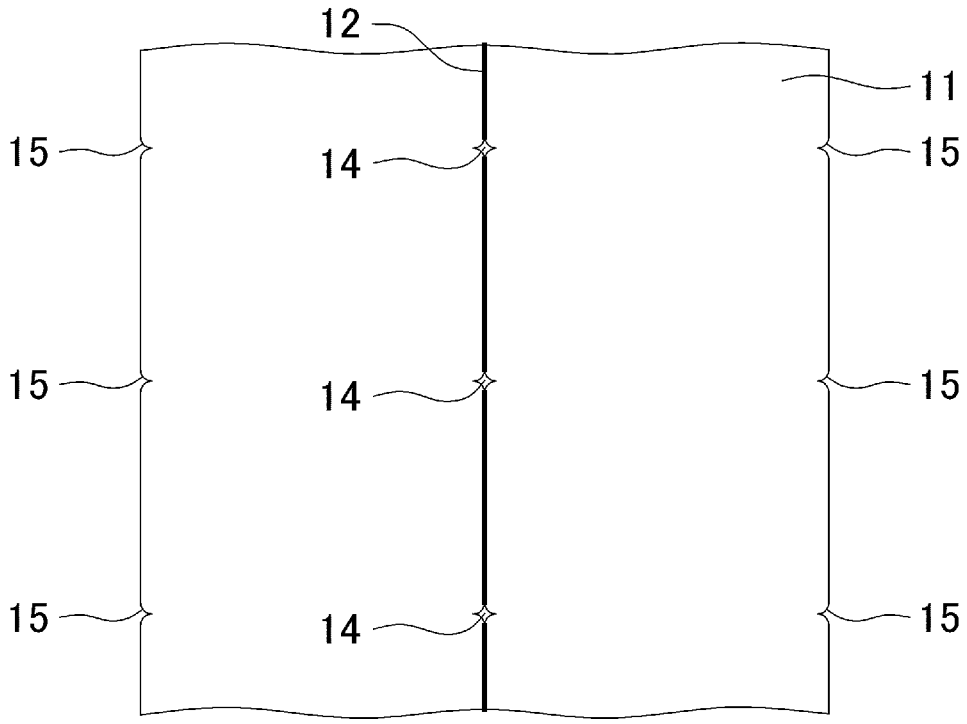
FIG. 5 is an explanatory view of a formation method for Shippo-pattern cutting parts.
Figure 6:
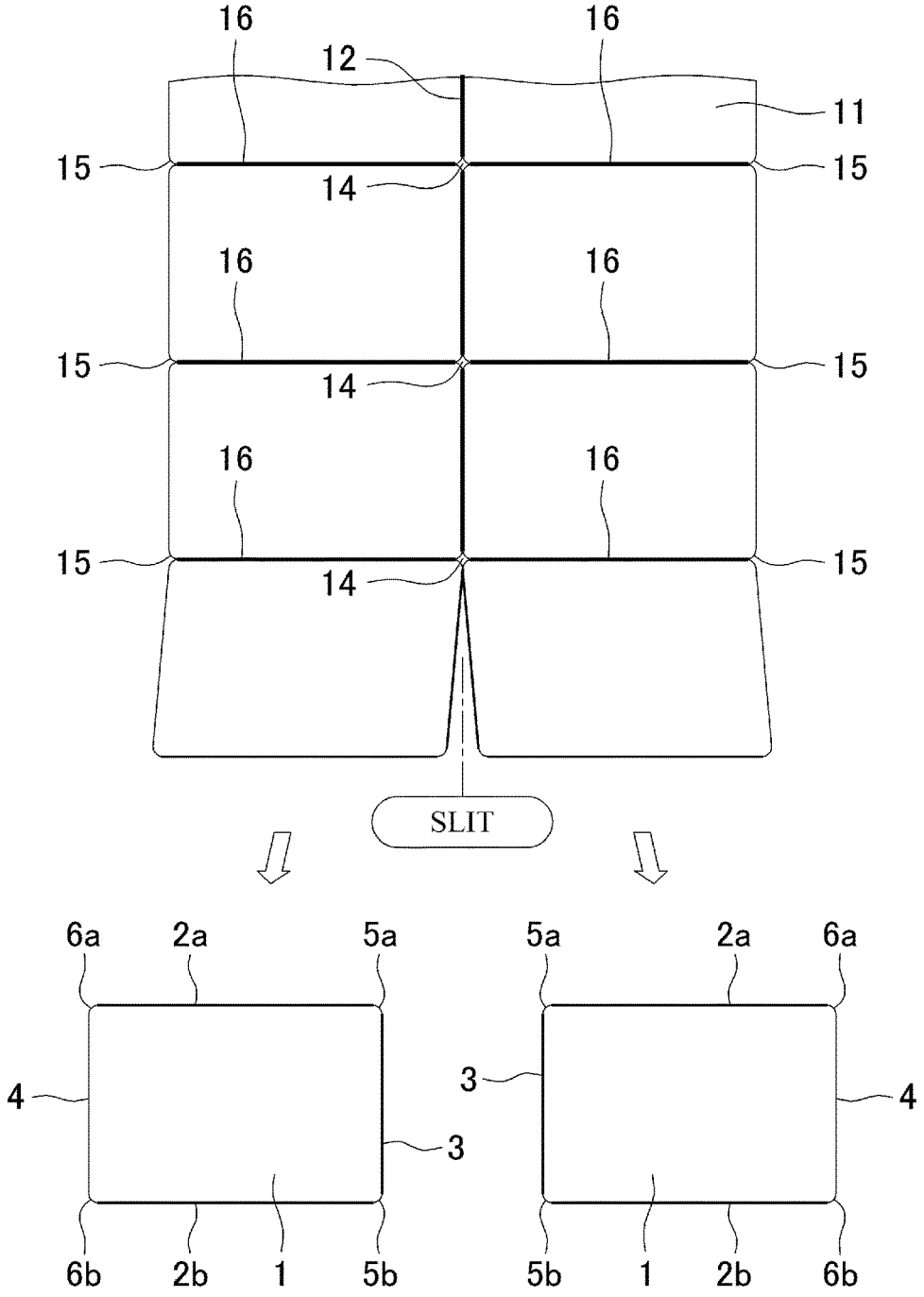
FIG. 6 is an explanatory view of a fusion cutting method for lateral sides as well as a manufactured state of individual protective bags.
Figure 7:
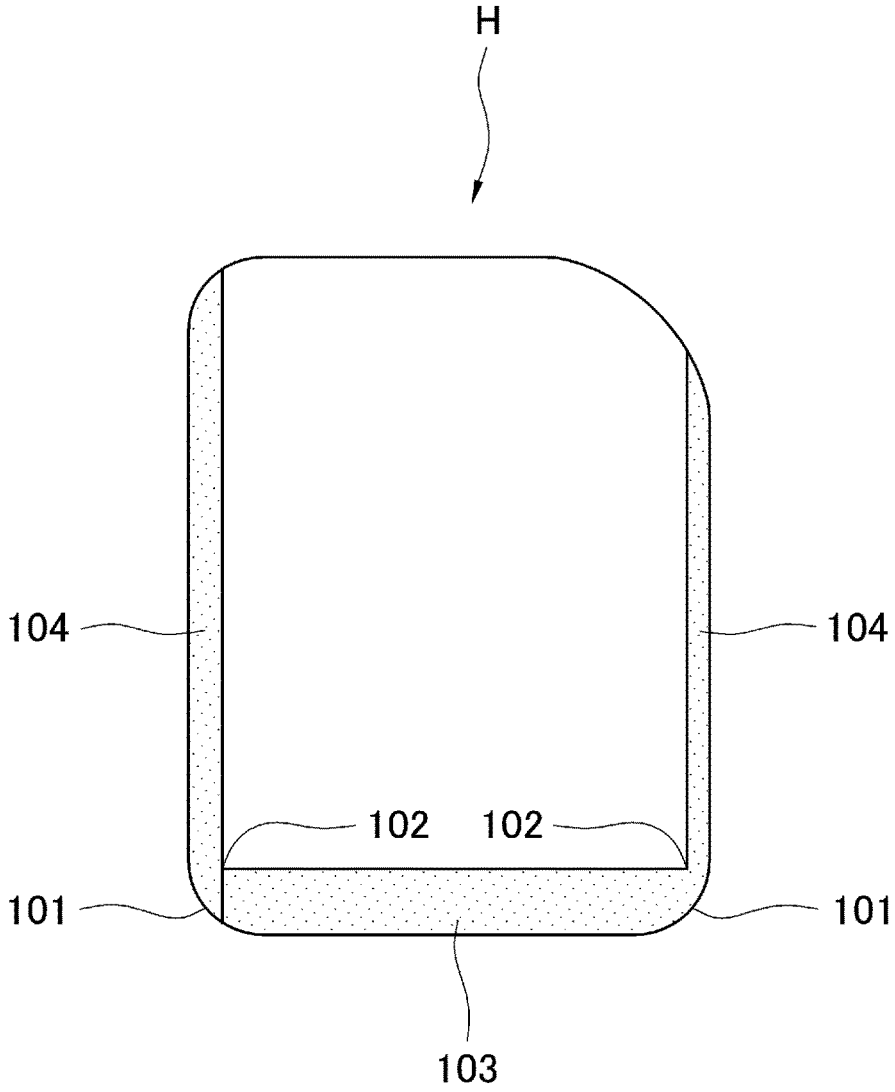
FIG. 7 is a schematic view of a conventional protective bag H.

The manufacturing method of the protective bag A for cards and the like, as shown in FIG. 3, includes:

(1) a step ST1 of applying ultrasonic welding to a center line at a widthwise central portion of a two-ply elongate film 11 having a specified width to form an ultrasonic welding part 12 (ultrasonic-welding-part forming step in FIG. 4);

(2) a step ST2 of cutting the opening part and the base corner portions (corner-portion cutting step in FIG. 5);

(3) a step ST3 of fusion cutting the lateral sides (lateral-side fusion cutting step in FIGS. 6); and (4) a step ST4 of cutting the ultrasonic welding part (cut-and-separation step in FIG. 6).

(Step ST1)

First at step ST1, with respect to an elongate, specified-width two-ply film 11 (wrapping-use laminate film) which is rolled out to run in continuous running, for example, a linear-shaped ultrasonic welding part 12 is formed so as to extend along a direction of flow of the widthwise central portion of the film and to have such a narrow width that no excess sealing margin is formed. In addition, the ultrasonic welding part 12 may be broken-line shaped other than linear-shaped, without being limited to the above-described shape. The film 11 may be fed by using a raw film roll made up of preparatorily laminated two-ply film, or by laminating films while rolling out films from previously provided two raw film rolls.

After welding process, the welded part is cooled so as to be stabilized. Usable for this cooling are such means as applying cold air to the welded part or bringing the welded part into contact with a metal plate for removal of heat.

In addition, unnecessary portions 17 at both-end edges (so-called selvedges) are removed by trimming. The both-end edges resulting from the trimming serve as edge sides of the opening part 4 of the protective bag A for cards and the like. Also, the film 11 corresponds to the films 1 of the protective bag A for cards and the like, the films 1 having been individualized on a one-film basis through the fusion cutting step of step ST5.

(Step ST2)

At step ST2, one Shippo-pattern cutting part 14 is formed on the ultrasonic welding line 12, and semi-Shippo-pattern cutting parts 15 are formed at each of film-sheet both end portions. The term "Shippo pattern" refers to a diamond-shaped quadrangle which is composed of inwardly concaved four lines each being a circular arc-shaped line. The term "semi-Shippo pattern" refers to a shape corresponding to one half of the Shippo pattern.

The cutting parts 14, 15 may be formed by using an up/down movable cutter or by using a rotary cutting roll.

The Shippo-pattern cutting part 14 at the central one point and the semi-Shippo-pattern cutting parts 15 at both-end two points may be formed either simultaneously or sequentially.

During this cutting step, the two sheets 11, which have been welded at the center line 12, are prevented from shifting in position.

It is recommended that each circular arc-shaped portion of the Shippo-pattern cutting part 14 have a diameter of 1 to 4 mm φ, preferably 3 mm φ.

In this case, as shown in FIG. 6, each Shippo-pattern cutting part 14 cut into the Shippo-pattern shape corresponds to the base corner portion 5*a* or 5*b* of the protective bag A for cards and the like, and each semi-Shippo-pattern cutting part 15 cut into the semi-Shippo-pattern shape corresponds to the opening corner portion 6*a* or 6*b* of the protective bag A for cards and the like.

(Step ST3)

At step 3, fusion cutting of the lateral sides is executed.

Positions where the fusion cutting is applied are positions 16 each passing through the cutting part 14 and the cutting parts 15. By this step, the lateral sides 2*a*, 2*b* of the protective bag A for cards and the like are welded together with a narrow width, and moreover neighboring front-and-back container bags A, A are cut off from each other.

(Step ST4)

At step ST4, at the place where the ultrasonic welding part 12 is provided, the film 11 is cut into two columns, for example, by a slitting blade.

In this case, as shown in FIG. 6, the cut ultrasonic welding part 12 corresponds to the base 3 of the protective bag A for cards and the like. Also, the fusion cutting positions 16 subjected to widthwise fusion cutting correspond to the lateral sides 2*a*, 2*b* of the protective bag A for cards and the like.

The fusion cutting step of step ST3 and the cutting step of step ST4 may be executed in this order or simultaneously or in a reverse order. Which one of these orders is applied may be determined depending on the structure of a manufacturing machine involved or the degree of dimensional accuracy to which the manufacturing machine can reach.

According to the above manufacturing method, the following advantages are provided.

(1) Conventionally, indeed linear-shaped fusion cutting of films has been possible, but circular arc-shaped fusion cutting of films has been hard, thus making it impossible heretofore to manufacture a protective bag A for cards and the like which is circular arc-shaped at its four corners and yet which is sealed along the circular-arc shapes. In contrast, since the base corner portions 5*a*, 5*b* are cut each into a circular-arc shape to form the base corner portions 5*a*, 5*b*, it is possible to manufacture the above-described protective bag A for cards and the like.

(2) Since the base corner portions 5*a*, 5*b* have not yet been welded at the time when the corner portions 5*a*, 5*b* are formed, there is an opening between two film sheets. Therefore, both ends of the card bag are soft, so that the player is kept from feeling a pain at the hands.

(3) There is a difficulty in the operation itself of fusion cutting the film 11 into a circular-arc shape and, what is more, it is also difficult to incorporate the step of fusion cutting the film 11 into a circular-arc shape into manufacturing process that involves high-speed processing. In contrast, as to the protective bag A for cards and the like, since the pair of lateral sides 2*a*, 2*b* are formed by fusion cutting and the base 3 is formed by ultrasonic welding and subsequent cutting, it is made practicable to subject a continuation of two-ply sheet-like films 11 to continuous processing including the process of cutting the base corner portions 5*a*, 5*b* each into a circular-arc shape and moreover cutting the opening corner portions 6*a*, 6*b* each into a circular-arc shape as well until the protective bags A for cards and the like are finally fusion cut individually so as to be fabricated on a one-unit basis. Thus, the protective bags A for cards and the like can be mass produced.

It should be noted that the present invention is not limited to the above-described embodiment alone and may naturally be modified and changed in various ways without departing from the gist of the invention.

REFERENCE SIGNS LIST

A protective bag for cards and the like
1 film
2*a*, 2*b* lateral side
3 base
4 opening part
5*a*, 5*b* base corner portion
6*a*, 6*b*, 6*a*', 6*b*' opening corner portion
11 film
12 ultrasonic welding part
14 Shippo-pattern cutting part
15 semi-Shippo-pattern cutting part
16 fusion cutting part
C card or the like

What is claimed is:

1. A protective bag for cards comprising two rectangular-shaped films of equal shape and size which are superposed on each other without any positional shift, three sides of the superposed two rectangular-shaped films being sealed so that an opening part is formed at one remaining side thereof, wherein each corner of the two rectangular-shaped films has a circular-arc shape when viewed in a direction perpendicular to a main surface of each of the two rectangular-shaped films, and the three sides of the superposed two rectangular-shaped films are sealed except the opening part and the each corner of the two rectangular-shaped films.

2. The protective bag for cards in accordance with claim 1, wherein the two corners that are not in direct contact with the opening part are each cut into the circular-arc shape without being welded.

3. The protective bag for cards in accordance with claim 2, wherein a pair of lateral sides that includes two opposing sides of the three sealed sides are formed by fusion cutting, and a base side that includes a side of the three sealed sides that is between the pair of two opposing lateral sides and opposite the open side of the protective bag is formed by ultrasonic welding and subsequent cutting.

4. The protective bag for cards in accordance with claim 1, wherein the superposed two rectangular-shaped films are in direct contact with each other at the three sides where the superposed two rectangular-shaped films are sealed.

5. The protective bag for cards in accordance with claim 2, wherein a pair of lateral sides that includes two opposing sides of the three sealed sides is formed by fusion cutting and thereby has no excess sealing margin outside a contour of the fusion cutting, and a base side that includes a side of the three sealed sides that is between the pair of opposing lateral sides and opposite the open side of the protective bag is formed by ultrasonic welding and subsequent cutting and thereby has no excess sealing margin outside a contour of the ultrasonic welding.

6. The protective bag for cards in accordance with claim 1, wherein each of the circular-arc shapes of the each corner of the two rectangular shaped films has a diameter of 1-4 mm φ.

7. The protective bag for cards in accordance with claim 1, wherein each of the circular-arc shapes of the each corner of the two rectangular shaped films has a diameter of 6 mm φ.

8. A protective bag for cards comprising:

a first rectangular-shaped film having a first main surface facing outside of the protective bag and a second main surface facing inside of the protective bag; and a second rectangular-shaped firm having a third main surface facing inside of the protective bag and a fourth main surface facing outside of the protective bag, wherein the first main surface, the second main surface, the third main surface, and the fourth mail surface have equal shape and size which are superposed on each other without any positional shift, wherein three sides of the superposed two rectangular-shaped films are sealed so that an opening part is formed at one remaining side thereof, wherein each corner of the two rectangular-shaped films has a circular-arc shape when viewed in a direction perpendicular to the first, second, third, and fourth main surfaces of the two rectangular-shaped films, and the three sides of the superposed two rectangular-shaped films are sealed, wherein the opening part and the each corner of the two rectangular-shaped films are not sealed, and wherein the second main surface and the third main surface are in direct contact with each other at the three sides.

* * * * *